United States Patent [19]

Meatto

[11] Patent Number: 4,706,985

[45] **Date of Patent: * Nov. 17, 1987**

[54] ALPINE SKI WITH SELECTIVE REINFORCEMENT

[75] Inventor: Franklin D. Meatto, Cromwell, Conn.

[73] Assignee: TriStar Sports Inc., Middletown, Conn.

[ * ] Notice: The portion of the term of this patent subsequent to Oct. 8, 2002 has been disclaimed.

[21] Appl. No.: 749,839

[22] Filed: Jun. 28, 1985

Related U.S. Application Data

[63] Continuation-in-part of Ser. No. 582,404, Feb. 22, 1984.

[51] Int. Cl.[4] ..... A63C 5/14

[52] U.S. Cl. ..... 280/610

[58] Field of Search ..... 280/601, 602, 610

[56] References Cited

U.S. PATENT DOCUMENTS

| | | | |
|---|---|---|---|
| 2,581,532 | 1/1952 | Hem | 280/11.13 |
| 2,648,543 | 8/1953 | Grabowski | 280/11.13 |
| 3,300,226 | 1/1967 | Reed, Jr. | 280/11.13 |
| 3,398,968 | 8/1968 | Mutzhas | 280/602 |
| 3,635,483 | 1/1972 | Barriball | 280/610 |
| 3,844,576 | 10/1974 | Schultes | 280/610 |
| 4,071,264 | 1/1978 | Legrand et al. | 280/610 |
| 4,221,400 | 9/1980 | Powers | 280/602 |
| 4,383,701 | 5/1983 | Hirnböck et al. | 280/610 |
| 4,412,687 | 11/1983 | Andre | 280/610 |
| 4,455,037 | 6/1984 | Pilpel | 280/610 |
| 4,556,237 | 12/1985 | Meatto et al. | 280/610 |

FOREIGN PATENT DOCUMENTS

| | | | |
|---|---|---|---|
| 2804943 | 8/1979 | Fed. Rep. of Germany | 280/610 |
| 1467141 | 12/1965 | France . | |
| 1526418 | 5/1967 | France . | |

*Primary Examiner*—John J. Love
*Assistant Examiner*—Eric D. Culbreth
*Attorney, Agent, or Firm*—Ralph D'Alessandro; Thomas P. O'Day

[57] ABSTRACT

In an alpine snow ski having a fiberglass sandwich construction there is provided at least one high strength fiber reinforcing rod positioned generally horizontally within the ski's cross-section extending forwardly from the binding area to the shovel contact point and rearwardly from the binding area to the tail contact point above or in the plane of the compression carrying laminate to increase the flexural response and compressive structural strength of the ski.

12 Claims, 5 Drawing Figures

ALPINE SKI WITH SELECTIVE REINFORCEMENT

This application is a continuation-in-part application of application Ser. No. 582,404 filed Feb. 22, 1984.

BACKGROUND OF THE INVENTION

This invention relates to an alpine ski structure and more specifically, it is concerned with high strength fiber reinforcing means positioned generally horizontally in the cross-section of a fiberglass sandwich-structured ski above or in the plane of the compression carrying laminate layer to selectively increase the flexural response and compressive strength of the ski.

The continued popularity of downhill skiing has focused attention on the structure of skis to produce a ski that provides greater responsiveness to the improved skiing techniques being employed by skiers today and the increased speed being achieved as a result of these techniques. This continued popularity has caused the materials used in skis to be changed in response to efforts to develop higher performance skis at lower manufacturing costs. Skis have been made solely from wood, composite wood-plastic materials, as well as entirely from plastics. Skis made entirely from metal have also been manufactured, as well as incorporating metal into composite wood-plastic skis or into all plastic skis. In particular, the advent of high performance wood-fiberglass and fiberglass-plastic foam skis has intensified the skiing industry's efforts to solve the problem of providing a ski constructed of quality materials which give increased ski return rates, increased torsional and flexural stiffness, increased flexural yield strength and a bottom steel running edge with increased impact resistance.

Different approaches have been taken in attempts to solve these problems as higher performance skis have evolved in the ski industry. Initially, skis were made with just a wooden core. A core made of plastic material, such as polyurethane placed within a honeycomb structure formed from aluminum, was employed for a limited time. Historically, skis have been manufactured by laminating, torsion box or reaction injection molding processes. However, because of the higher performance nature of today's skis, these composite skis are subjected to greater flexibility strains which the aforementioned constructions have either failed to withstand or have provided skis which produce a dead sensation to the user. High strength, man-made fibers have been recently incorporated into skis with a fiberglass-sandwich structure to attempt to increase the responsiveness of the ski.

None of the aforementioned structures have provided skis which balance the considerations of high material costs, increased responsiveness, decreased weight, increased structural strength, reproducibility of physical properties in manufacture, and uniform and efficient dispersion of the high strength fibers in the cross-section of the ski during manufacture. Prior ski designs incorporating high strength fibers have inefficiently and randomly placed the fibers during manufacture. This has resulted in a wide variation of physical properties among the final products of skis of supposedly the same design.

The foregoing problems are solved in the design of the present invention by providing in a fiberglass sandwich-structured alpine ski selectively positioned pultruded high strength fiber reinforcing means above or in the plane of the compression carrying laminate.

SUMMARY OF THE INVENTION

It is an object of the present invention to provide in an alpine snow ski high strength fiber reinforcing means to increase the compressive strength and responsiveness of the ski in an efficient and reproducible manner.

It is another object of the present invention to provide in an alpine snow ski selective or localized placement of high strength fiber reinforcing means to increase strength and response in only areas of highest stress in the ski.

It is a feature of the present invention that pultruded 100% high strength fiber is selectively positioned in the ski above or in the plane of the compression carrying laminate layer.

It is another feature of the present invention that the high strength fiber reinforcing means can be discontinuously positioned along the axial length of the ski to maximize the amount of high strength fibers in the required areas of the forebody and the afterbody of the ski.

It is another feature of the present invention that the high strength fiber reinforcing means may be symmetrically arrayed across the cross-section between the opposing sides of the ski.

It is still another feature of the present invention that high strength fiber reinforcing means are placed in machined slots or pultruded into the laminate layer.

It is an advantage of the present invention that the high strength fiber reinforcing means are selectively positioned where they are the most effective.

It is another advantage of the present invention that the high strength fiber reinforcing means can be premeasured for physical properties prior to inclusion in the ski's sandwich structure to ensure the reproducibility of the physical properties of the assembled ski during manufacture.

It is still another advantage of the present invention that reinforcement is achieved only in those areas of the ski which experience the largest deflection during use.

It is yet another advantage of the present invention that increased flexural yield and ultimate strength is obtained over skis of equivalent cross-section, stiffness and flexure.

These and other objects, features and advantages are obtained by providing in an alpine snow ski having a fiberglass sandwich construction at least one high strength fiber reinforcing means positioned generally horizontally within the cross-section of the ski and above or in the plane of the compression carrying laminate extending forwardly from the binding area to the shovel contact point and rearwardly from the binding area to the tail contact point to increase the flexural response and compressive strength of the ski.

BRIEF DESCRIPTION OF THE DRAWINGS

The advantages of this invention will become apparent upon consideration of the following detailed disclosure of the invention, especially when it is taken in conjunction with the drawings wherein.

DETAILED DESCRIPTION OF THE PREFERRED EMBODIMENT

Figure 1:
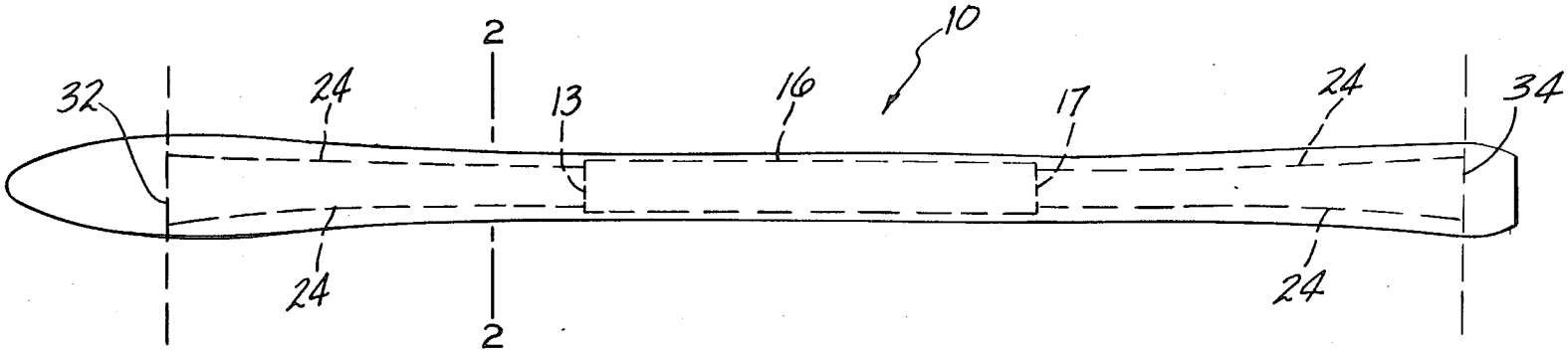
FIG. 1 is a top plan view of an alpine snow ski showing the fiber reinforcing means and the binding plate area in dotted lines.

Referring to FIG. 1, there is seen in a top plan view a snow ski 10 having a binding plate 16, shown in dotted lines, embedded therein. Binding plate 16 has a front portion 13 nearest the shovel contact point 32 and a rear portion 17 nearest the tail contact point 34 of the ski 10. These contact points are the lines of contact of the ski where the shovel and tail of the ski under the force of only its own weight touch a flat surface. High strength fiber reinforcing means 24 are shown in dotted lines as extending forwardly from the front portion 13 of the binding plate area to the shovel contact point 32 and rearwardly from the rear portion 17 of the binding plate area to the tail contact point 34. The fiber reinforcing means 24 are beneath the surface of the ski 10 and are discontinuous in the area of the binding plate 16 as they run axially along the ski 10 between the tail contact point 34 and the shovel contact point 32.

The fiber reinforcing means 24 are preferably formed from high strength, man-made fibers, such as unidirectional graphite fiber reinforced epoxy rods. They could also be formed from boron fibers or any of the family of aramid fibers sold under the KEVLAR tradename of the E.I. DuPont deNemours Company, hereinafter referred to only as DuPont. The fiber reinforcing means 24 are formed by pultruding the material into the desired shape, such as a round or rectangular or any other suitable cross-sectional configuration. The preferred composition of the fiber reinforcing means 24 is 70% by weight unidirectional graphite fiber reinforced epoxy. The fiber reinforcing means 24 increase the overall resistance to flexural deformation of the structure of the ski 10 by selectively increasing the flexural or bending strength when compared to a cross-sectional beam of equivalent stiffness without such fiber reinforcing means 24. Testing has found that this increase in bending strength is in the range of about 11% to about 14%. The fiber reinforcing means 24 also increase the flexural and torsional response rate of the ski 10 in only those areas which undergo the largest deflection during use.

The fiber reinforcing means 24 may be pretested for physical properties prior to inclusion into the sandwich structure of the ski 10 to ensure that these desired physical properties may be reliably reproduced within design tolerances in skis during the manufacturing process. Tests are conducted for flexural strength and modulus of elasticity in flexure, adhesive bond strength in shear and, where graphite is employed, graphite fiber percent composition by weight of the fiber reinforcing means. Thus, the physical properties of fiber reinforcing means 24 are determined independently of the final laminated ski sandwich structure.

The fiber reinforcing means 24 are located with respect to the cross-section of the ski 10 on the compression side or in the compression portion of the sandwich structure of the ski 10, which positions them above the neutral axis of the ski beam. This permits the fiber reinforcing means 24 to be positioned above, below or in the plane of the compression carrying laminate layer 15, as desired.

Figure 2:
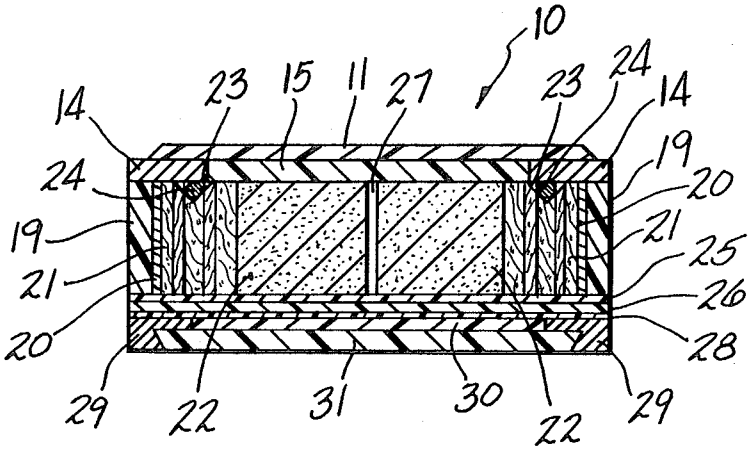
FIG. 2 is a sectional view taken along the lines 2—2 of FIG. 1 of the present invention.

The cross-sectional configuration of the ski 10 is best seen in the embodiment shown in FIG. 2. Ski 10 is shown as having a top surface 11 which overlies the top edges 14 and the compression carrying laminate layer 15. The core of the ski 10 is formed from a combination of a polyurethane core portion 22, a wood portion 21 and reinforcing ribs 20. A wedge space 27 is seen separating the two polyurethane core portions 22. Fiber reinforcing means 24 are at least partially embedded in a machined slot 23 in the wood core portions 21. Sidewalls 19 protect the side of the skis and are positioned generally vertically adjacent the reinforcing ribs 20 on the opposing first and second sides of the ski. Underlying the core portions 20, 21 and 22 and the sidewalls 19 is a torsional stiffness reinforcing layer 25. Beneath the torsional stiffness reinforcing layer 25 is a tensile carrying or main facing laminate layer 26. Along the first and second sides of the cross-section of the ski 10 along the axial length are the bottom edge means 29. Above the bottom edge means 29 and beneath the main facing laminate layer 26 is a bottom foil layer 28. A bottom running surface 31 underlies the thermal balance layer 30 and lies between the bottom edge means 29 and the opposing first and second sides of the ski 10.

Figure 3:
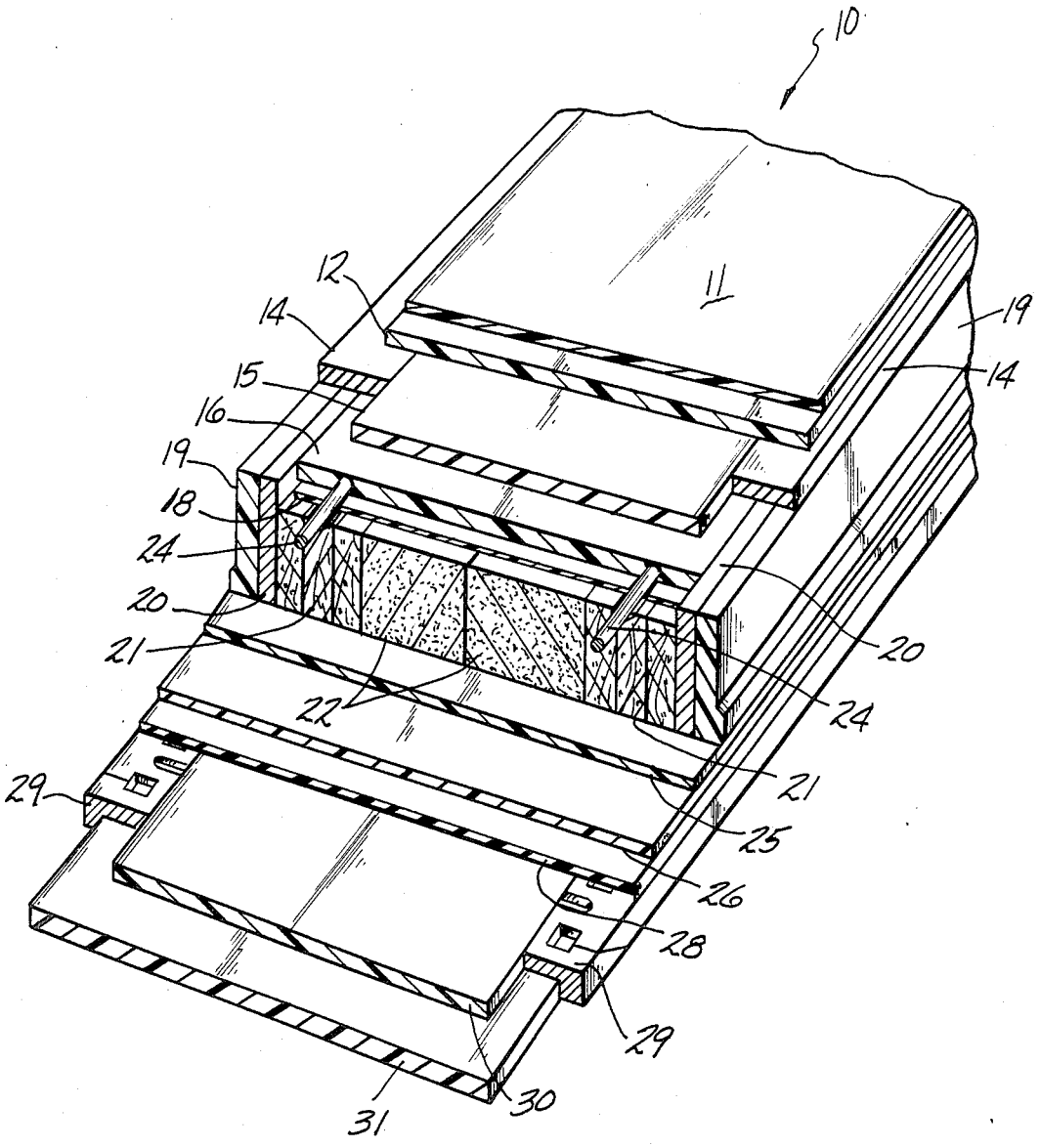
FIG. 3 is an enlarged partial side perspective view of an alternative embodiment of an alpine snow ski utilizing fiber reinforcing means.

FIG. 3 shows in enlarged and partial side perspective view an alternative ski structural embodiment employing fiber reinforcing means 24. The cross-sectional configuration is the same except for the addition of a transverse woven fiberglass reinforced epoxy sheet 12 beneath the top surface 11 and above the compression carrying laminate 15 and the top edges 14.

The top surface 11 is preferably formed from a thermoplastic urethane sheet that is easily pigmented and has an extremely high resistance to abrasion and cutting. Other materials, such as acrylonitrile butadiene styrene (ABS) could be employed, but are less preferable. Where employed, the transverse woven fiberglass reinforced epoxy sheet 12 supports the top surface 11 during manufacture and increases the transverse strength of the ski without affecting the flexural properties. The compression carrying laminate layer 15 is preferably formed from 70% by weight unidirectional, glass-fiber reinforced epoxy to resist substantially all the compressive loading in the mid-section or binding area of the top of the ski 10 during usage. This layer 15 resists a majority of the compressive forces in the forebody and the afterbody of the ski 10, aided by the fiber reinforcing means 24. The top edge means 14 are preferably formed of an appropriate material such as plastic or metal to protect the top corners of the ski 10. Selection of the appropriate metal, such as aluminum, also increases the average compressive modulus of the top portion of the sandwich structure of the ski 10. This in turn lowers the compressive stress and shear on the bonding lines between the laminates.

The core is formed from the previously described core portions 20, 21 and 22. The polyurethane foam core portion 22 supports the mid-section of the ski 10 during manufacture and contributes to the overall weight reduction of the ski. This structure also helps the ski 10 withstand shear forces that may develop between the compression carrying laminate layer 15 and the torsional stiffness reinforcing layer 25. The wood core portion 21 is formed from layers of aspen and birch, preferably, which are laminated together so that the layers are generally perpendicular to the top surface 11 and the bottom running surface 31. The layers of aspen birch are ultimately laminated together by an appropriate adhesive. The reinforcing rib portion of the core 21 is preferably formed from a high strength material, such as aluminum or graphite, to increase the average modulus of elasticity to average cross-sectional density ratio of the ski 10. This particular structure increases the structural rate of return from a deflected position for a beam of constant stiffness while reinforcing the bottom edge means 29.

As can be seen in FIG. 2, the ski is generally symmetrically divided by the wedge space 27. The wedge space is narrow in the center of the ski 10 but widens as the shovel contact point 32 and tail contact point 34 are approached. Wedge space 27 is a hollow air space into which are emplaced approximately three wedges (not shown) so that the core may be formed during the manufacture of the ski to conform to the side cut or geometry of the ski 10, as seen in FIG. 1.

The sidewalls 19 may be formed from either the aforementioned ABS or from a colaminated ionomer. An appropriate colaminated ionomer, such as that sold under the tradename SURLYN by DuPont, tends to be more abrasion resistant and elastic than ABS.

The torsional stiffness reinforcing layer 25 underlying the core is preferably formed from 78% by weight glass-fiber reinforced epoxy to control the torsional stiffness and reinforce the ski against impact during use. This torsional stiffness reinforcing layer is generally formed from ±45° oriented glass fibers. Beneath that, the main facing laminate layer 26 is comprised of 70% by weight unidirection glass-fiber reinforced epoxy. This layer acts as the main facing laminate for the bottom of the ski and carries substantially all of the tensile loading in flexure. The thermal balance layer 30 underlies layer 36 and is formed generally from medium molecular weight polyethylene to create an expansion and contraction balance with the upper portion of the ski 10. This helps to facilitate maintaining the ski's geometry throughout the range of temperatures the ski will be subjected to during use. The bottom foil layer 28 is an appropriate ionomer, such as that sold under the aforementioned tradename SURLYN which serves as an adhesive barrier and shear layer between the main facing laminate layer 26 and the bottom edge means 29.

Bottom edge means 29 may either be a solid edge or a cracked edge, as desired. If the bottom edge means 29 are cracked, as is well known in the art, less vibration is transmitted to the ski.

The bottom running surface 31 is preferably formed from an ultra high molecular weight polymer, such as, for example polyethylene with carbon filler, to offer extremely high resistance to abrasion. This increases the life of the running surface 31 and the gliding properties. The carbon filler increases the conductivity of the running surface 31 to thereby dissipate any potential static charge created during movement of the ski across the snow surface. Where a binding foil 18 is employed between the binding plate 16 and the core portions 21 and 22, as seen in FIG. 3, a suitable elastomer is employed, such as rubber or the ionomer sold under the aforementioned tradename SURLYN. A random fiberglass reinforced polyester may be used for the binding plate 16 which defines the general binding plate area in the midsection of the ski 10. Selection of this type of material provides the required binding retention for mounting fasteners of the binding to the ski.

Figure 4:
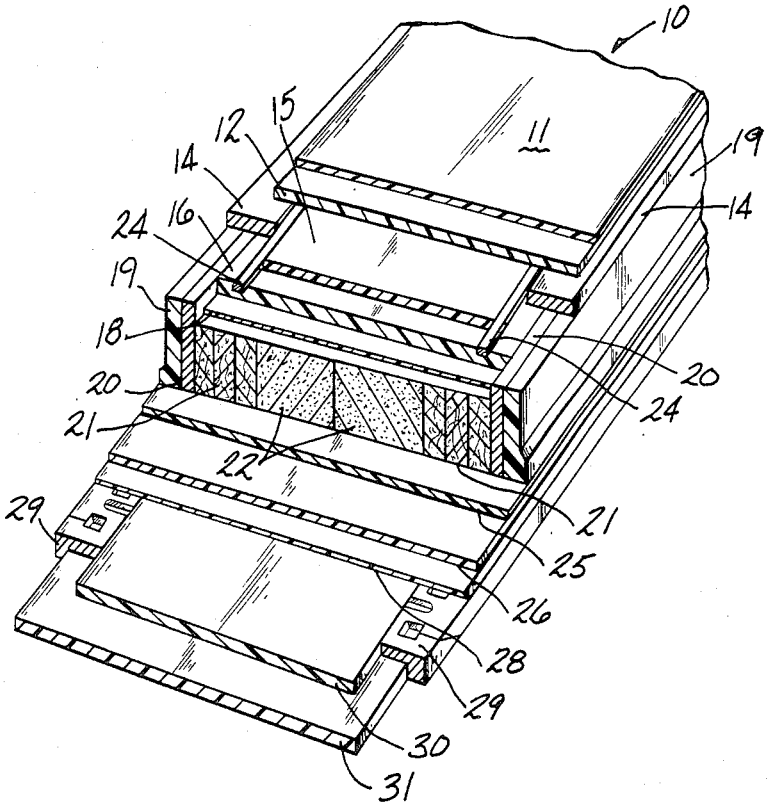
FIG. 4 is an enlarged partial side perspective view of an alpine snow ski utilizing rectangularly shaped fiber reinforcing means inserted in the plane of the compression carrying laminate layer.
Figure 5:
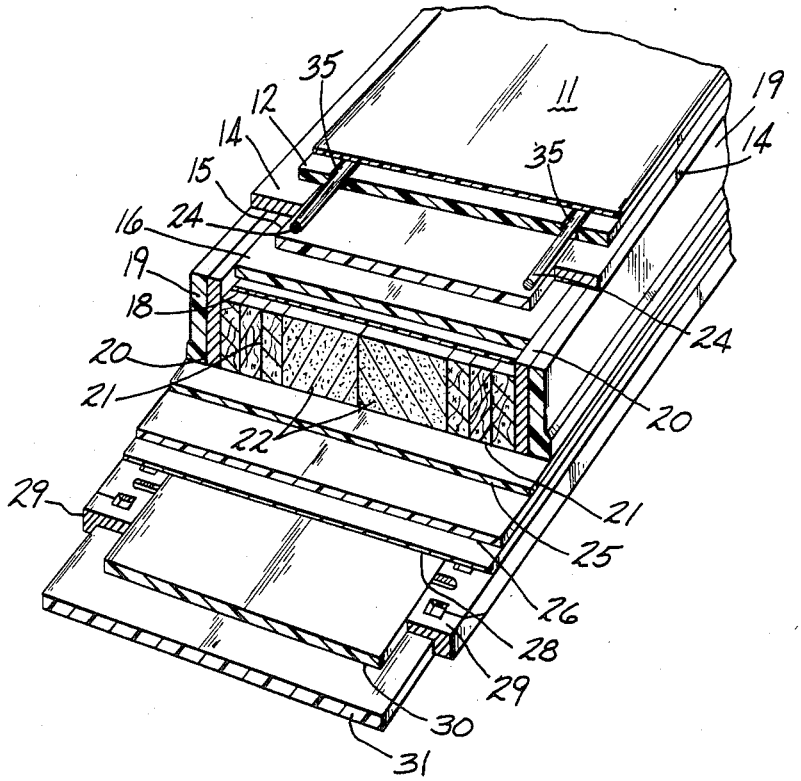
FIG. 5 is an enlarged partial side perspective view of an alpine snow ski utilizing generally round shaped fiber reinforcing means above the plane of the compression carrying laminate layer.

FIGS. 4 and 5 show alternative ski structural embodiments essentially the same as in FIG. 3, except with the fiber reinforcing means 24 inserted in the plane of the compression carrying laminate 15 and above the compression carrying laminate, respectively. In FIG. 4 the fiber reinforcing means 24 are shown having a generally rectangular cross-section and are placed between and adjacent the top edges 14 and the compression carrying laminate 15. It is to be understood that the fiber reinforcing means could equally well be pultruded within or placed within slots in the compression carrying laminate 15. In FIG. 5 the fiber reinforcing means 24 are shown as having a generally circular or round cross-sectional configuration inserted in the plane of the transverse woven fiberglass reinforced epoxy sheet layer 12, but above the compression carrying laminate layer 15. The fiber reinforcing means 24 may be pultruded within or placed in slots 35 in the layer 12. When placed as shown in FIG. 5, the fiber reinforcing means, if extruded in layer 12, would likely be continuous from the shovel to the tail of the ski to facilitate manufacturing.

While the preferred structure in which the principles of the present invention have been incorporated is shown and described above, it is to be understood that the invention is not to be limited to the particular details thus presented, but in fact, widely different means may be employed in the practice of the broader aspects of this invention. For example, two torsional reinforcing layers could simultaneously be employed in the ski, such as one above and one below the core. The scope of the appended claims is intended to encompass all obvious changes in the details, materials and arrangement of parts which will occur to one of skill in the art upon a reading of the disclosure.

Having thus described the invention, what is claimed is:

1. In a snow ski having a predetermined cross-section with opposing first and second sides, the ski extending a desired axial length from a forward shovel area to a rear tail area, comprising in combination:

(a) a bottom running surface;

(b) a top surface;

(c) a core positioned between the bottom running surface and the top surface;

(d) a compression carrying laminate layer positioned above the core and below the top surface;

(e) a binding area intermediate the tail area and the shovel area having a front portion nearest the shovel area and a rear portion nearest the tail area;

(f) a main facing laminate layer positioned below the core and above the bottom running surface for carrying the substantial portion of the tensile loading in flexure;

(g) top edge means extending substantially the axial length along the opposing first and second sides of the ski adjacent the compression carrying laminate layer;

(h) bottom edge means extending substantially the axial length along the opposing first and second sides of the ski adjacent the bottom running surface to provide wear-resistant surfaces;

(i) a fiber reinforced layer positioned above the compression carrying laminate layer and below the top surface; and (j) at least one high strength fiber reinforcing means generally horizontally positioned at least partially in a slot in the fiber reinforced layer within the cross-section extending forwardly at least from the front portion of the binding area to the shovel area and rearwardly from at least the rear portion of the binding area to the tail area external of the compression carrying laminate layer in the compression portion of the cross-section to increase the flexural response and compressive strength of the ski.

2. The apparatus according to claim 1 wherein the fiber reinforcing means is further continuous along the axial length of the ski between the front portion of the binding plate and the shovel area and the rear portion of the binding plate and the tail area.

3. The apparatus according to claim 2 wherein the fiber reinforcing means further comprises a plurality of fiber reinforcing means symmetrically arrayed across the cross-section of the ski between the opposing first and second sides.

4. The apparatus according to claim 1 wherein the fiber reinforcing means further comprises a round cross-section.

5. The apparatus according to claim 1 wherein the fiber reinforcing means further comprises a generally rectangular cross-section.

6. The apparatus according to claim 1 wherein the core further comprises wood.

7. The apparatus to claim 1 wherein the core further comprises a combination of wood-foam.

8. The apparatus according to claim 6 further comprising a reinforcing rib means extending generally vertically upwardly from the bottom edge means adjacent the wood core on the opposing first and second sides of the ski.

9. The apparatus according to claim 7 further comprising a reinforcing rib means extending generally vertically upwardly from the bottom edge means adjacent the wood-foam core on the opposing first and second sides of the ski.

10. The apparatus according to claim 2 further comprising a thermal balance layer positioned between the bottom edge means and below the main facing laminate layer and above the bottom running surface.

11. The apparatus according to claim 10 further comprising a woven fiber reinforced plastic layer positioned above the compression carrying laminate layer and below the top surface to increase the transverse strength of the ski.

12. The apparatus according to claim 11 further comprising colaminated ionomer side walls along the opposing first and second sides of the ski to protect the sides of the ski.

* * * * *